US008887320B2

(12) United States Patent
DeZarn et al.

(10) Patent No.: US 8,887,320 B2
(45) Date of Patent: Nov. 18, 2014

(54) FLOW PROJECTOR DEVICE

(76) Inventors: Ernest Lee DeZarn, Fox Lake, WI (US); John Dennis Wolfe, Fremont, CA (US)

( * ) Notice: Subject to any disclaimer, the term of this patent is extended or adjusted under 35 U.S.C. 154(b) by 482 days.

(21) Appl. No.: 13/234,566

(22) Filed: Sep. 16, 2011

(65) Prior Publication Data

US 2012/0066824 A1 Mar. 22, 2012

Related U.S. Application Data

(60) Provisional application No. 61/385,061, filed on Sep. 21, 2010.

(51) Int. Cl.
*E03D 9/00* (2006.01)
*A47K 13/08* (2006.01)

(52) U.S. Cl.
CPC ... *A47K 13/08* (2013.01); *Y10S 4/05* (2013.01)
USPC ..... 4/300.3; 4/DIG. 5

(58) Field of Classification Search
USPC ..... 4/300.3, DIG. 15
See application file for complete search history.

(56) References Cited

U.S. PATENT DOCUMENTS

| | | | | |
|---|---|---|---|---|
| 217,163 | A | 7/1879 | Smith | |
| 1,857,328 | A | 5/1932 | Piper | |
| 2,407,005 | A | 9/1946 | Haley | |
| 2,709,816 | A * | 6/1955 | Lamb | 4/239 |
| 4,716,602 | A | 1/1988 | Brickhouse | |
| 4,910,815 | A | 3/1990 | Kelley | |
| 5,625,905 | A * | 5/1997 | Woods | 4/300.3 |
| 6,289,527 | B1 | 9/2001 | Truettner | |
| 6,408,447 | B1 | 6/2002 | Burbank et al. | |
| 7,225,481 | B2 | 6/2007 | Culmer | |
| 2006/0041998 | A1 * | 3/2006 | Lattanzi | 4/300.3 |
| 2010/0263115 | A1 * | 10/2010 | Thom et al. | 4/300.3 |

* cited by examiner

*Primary Examiner* — Lauren Crane
(74) *Attorney, Agent, or Firm* — James F. Hann; Haynes Beffel & Wolfeld LLP

(57) ABSTRACT

A flow projector device is used between the rim of a toilet bowl and an overlying seat. The flow projector device includes a base having an upper surface, a lower support surface, an inner end, an outer end, and lateral sides extending between the inner and outer ends. The upper surface slopes downwardly from the outer end toward the inner end. The device also includes a return portion and an outer barrier. The return portion extends downwardly from the inner end. The outer barrier extends upwardly from the outer end. The outer barrier includes a recurved surface configured to redirect urine to the upper surface of the base. Urine directed along the upper surface towards the recurved surface can be redirected by the recurved surface back onto the upper surface of the base to flow down the upper surface, past the return portion and into the toilet bowl.

17 Claims, 6 Drawing Sheets

FLOW PROJECTOR DEVICE

CROSS-REFERENCE TO OTHER APPLICATIONS

This application claims the benefit of U.S. provisional patent application No. 61/385,061 filed 21 Sep. 2010.

FEDERALLY SPONSORED RESEARCH OR DEVELOPMENT

None.

BACKGROUND OF THE INVENTION

There is a problem, not often discussed, of urine spilling between the seat and rim of a toilet when a man or a young boy sits on a toilet to urinate. This issue can arise with older men, men with medical problems (i.e. diabetes), overweight men, men using steroid-based medication, and can arise for other reasons when men sit to urinate. This is a well recognized issue when young boys sit to urinate.

In addition to being messy, there is a hygienic issue relating to urine on the floor. Urine is liquid biological waste and as such contains a resource for bacteria to grow. Left on the floor, it can be a health hazard. More and more men are taking insulin and still spill sugar in their urine, increasing the chance of bacterial growth on the floor near the toilet, increasing the possibility of infection if stepped on with bare feet.

BRIEF SUMMARY OF THE INVENTION

An example of a flow projector device captures the urine and returns it to the toilet bowl instead of the urine flowing between the seat and the rim of the toilet bowl. An example of a flow projector device may also prove be useful for young families with young male children, including providing a novel approach to potty training.

An example of a flow projector device is used between the rim of a toilet bowl and an overlying seat. The flow projector device includes a base having an upper surface, a lower support surface, an inner end, an outer end, and lateral sides extending between the inner and outer ends. The upper surface slopes downwardly from the outer end toward the inner end. The device also includes a return portion and an outer barrier. The return portion extends downwardly from the inner end. The outer barrier extends upwardly from the outer end. The outer barrier includes a recurved surface configured to redirect urine to the upper surface of the base. Urine directed along the upper surface towards the recurved surface can be redirected by the recurved surface back onto the upper surface of the base to flow down the upper surface, past the return portion and into the toilet bowl. In some examples the device includes sidewalls extending upwardly from the upper surface of the base along the lateral sides. In some examples the device includes a support bracket extending downwardly from the outer end of the base. In some examples the recurved surface has first and second portions, the first portion extending from the base generally upwardly away from the upper surface of the base and the second portion extending from the first portion generally downwardly toward the upper surface of the base. The recurved surface defines a urine catch/return cavity.

An example of a flow projector assembly includes a toilet and a flow projector device. The toilet includes a toilet bowl and an overlying seat, the seat having a lower seat surface. The toilet bowl includes a rim having an upper rim surface opposite the lower seat surface, an outer surface and an inner surface. The flow projector device includes a base, a return portion, an outer barrier, sidewalls and a support bracket. The base has an upper surface, a lower support surface, an inner end, an outer end, and lateral sides extending between the inner and outer ends. The upper surface slopes downwardly from the outer end toward the inner end. The return portion extends downwardly from the inner end. The outer barrier extends upwardly from the outer end. The outer barrier includes a recurved surface configured to redirect urine to the upper surface of the base. The recurved surface has first and second portions, the first portion extending from the base generally upwardly away from the upper surface and the second portion extending from the first portion generally downwardly toward the upper surface. The second surface portion terminates at a position overlying the upper surface of the base. The sidewalls extend upwardly from the upper surface of the base along the lateral sides, the sidewall having upper sidewall surfaces. The support bracket extends downwardly from the outer end of the base. The flow projector device is positioned between the rim of the toilet bowl and the seat, with the return portion opposite the inner surface of the rim, the support bracket opposite the outer surface of the rim, the base resting on the upper rim surface and the lower seat surface adjacent to the upper sidewall surfaces. A gap is defined between the upper surface of the base and the lower seat surface. Urine directed into the gap from the inner edge of the base and along the upper surface towards the recurved surface can be redirected by the second surface portion of the recurved surface back onto the upper surface to flow down the upper surface, past the return portion and into the toilet bowl.

Other features, aspects and advantages of the present invention can be seen on review the figures, the detailed description, and the claims which follow.

DETAILED DESCRIPTION OF THE INVENTION

Figure 1:
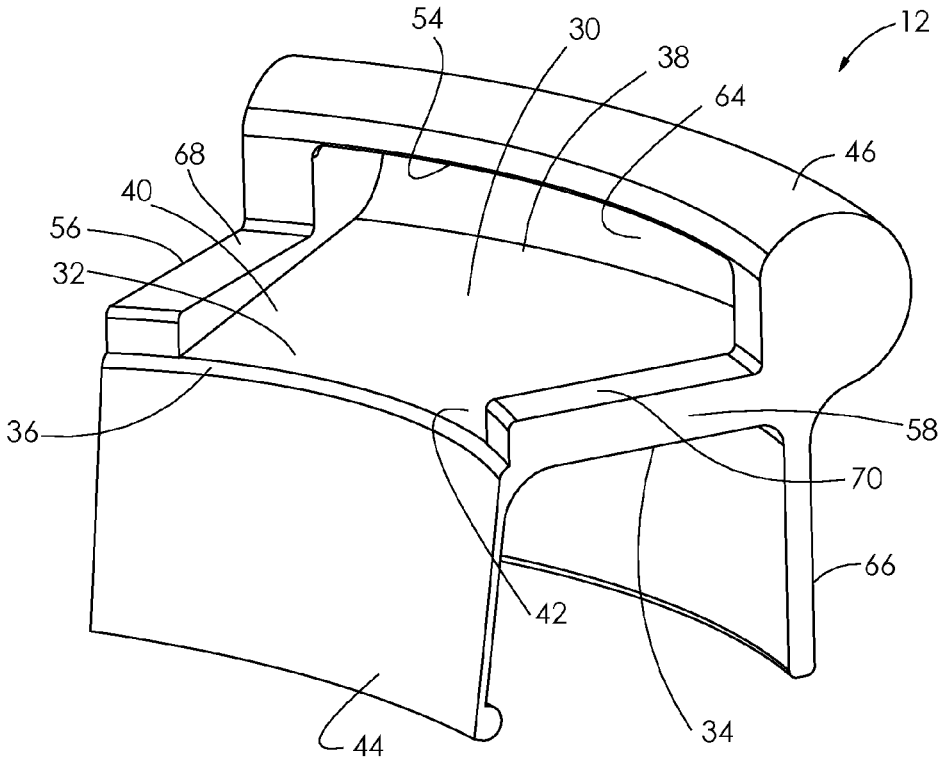
FIG. 1 is an overall view of an example of a flow projector device.

The following description will typically be with reference to specific structural embodiments and methods. It is to be understood that there is no intention to limit the invention to the specifically disclosed embodiments and methods but that the invention may be practiced using other features, elements, methods and embodiments. Preferred embodiments are described to illustrate the present invention, not to limit its scope, which is defined by the claims. Those of ordinary skill in the art will recognize a variety of equivalent variations on the description that follows. Like elements in various embodiments are commonly referred to with like reference numerals.

Referring now to FIGS. 1-7, a flow projector assembly 10 is shown to include a flow projector device 12 used with a toilet 14. The toilet 14 comprises a toilet bowl 16 and an overlying seat 18. The seat has a lower seat surface 20. The toilet bowl 16 includes a rim 22 having an upper rim surface 24 opposite the lower seat surface 20. Rim 22 also has a curved outer surface 26 and a curved inner surface 28.

Flow projector device 12 includes a base 30 having an upper surface 32, a lower support surface 34, an inner end 36, an outer end 38, and lateral sides 40, 42 extending between the inner and outer ends. The distance between inner end 36 and outer end 38 is about 2 to 3.5 inches, typically about 2.4 inches as in this example. As seen best in FIG. 5, the upper surface 32 is thicker at outer end 38 and at inner end 36 so that upper surface 32 slopes downwardly from the outer end 38 toward the inner end 36. In this example the thickness of base 30 at inner end 36 is about 0.125 inch while the thickness at outer end 38 is about 0.250 inch. While in this example upper surface 32 is generally flat, it may have other appropriate surface shapes. In some examples the downwardly sloping upper surface 32 slopes at an angle to the lower support surface 34 of base 30 of about 12° to 20°, specifically about 16° for this example. Device 12 also includes a return portion 44 extending downwardly and inwardly from the inner end 36 of base 30. Both inner end 36 and return portion 44 have curved shapes to generally correspond to the curvature of inner rim surface 28.

Figure 2:
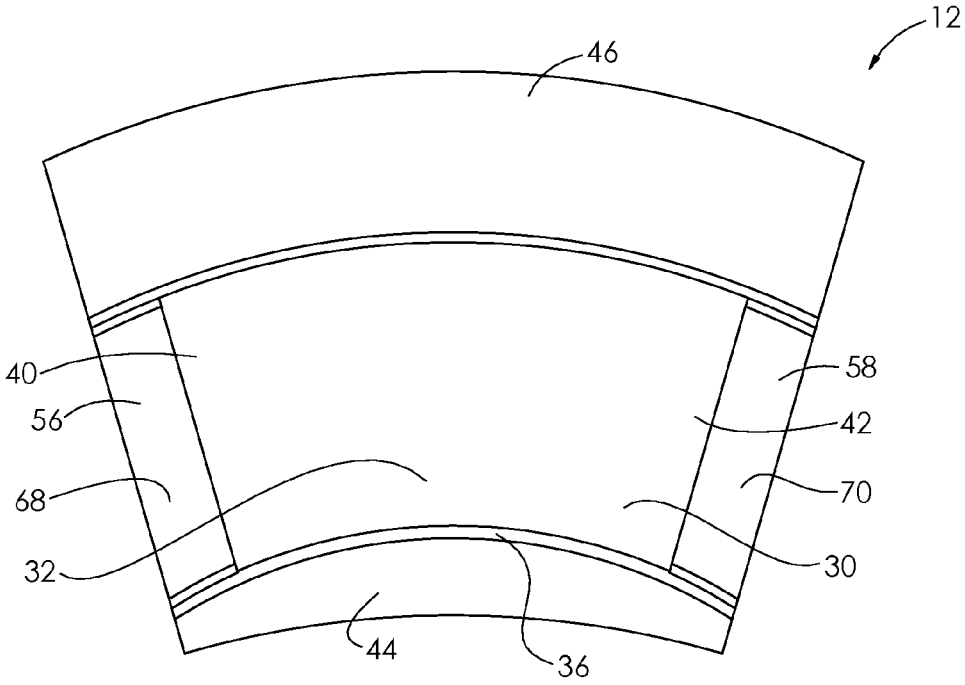
FIG. 2 is a top plan view of the device of FIG. 1.
Figure 3:
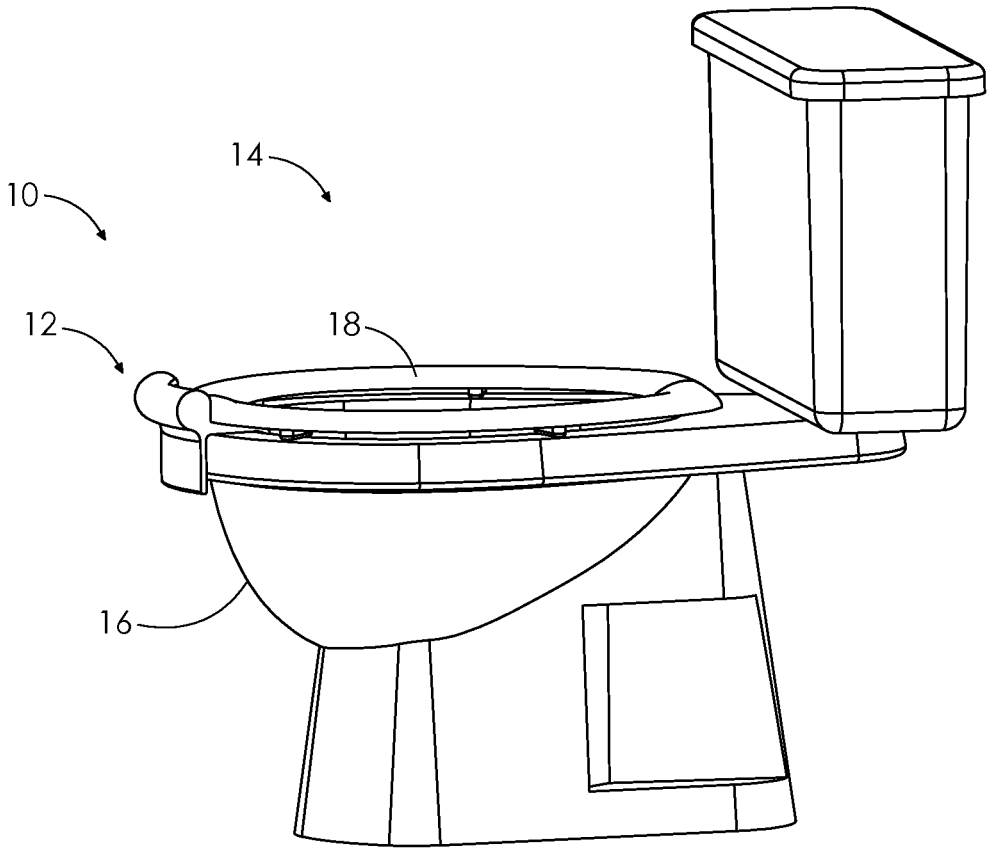
FIG. 3 is an example of a flow projector assembly including a toilet and the flow projector device of FIG. 1.
Figure 4:
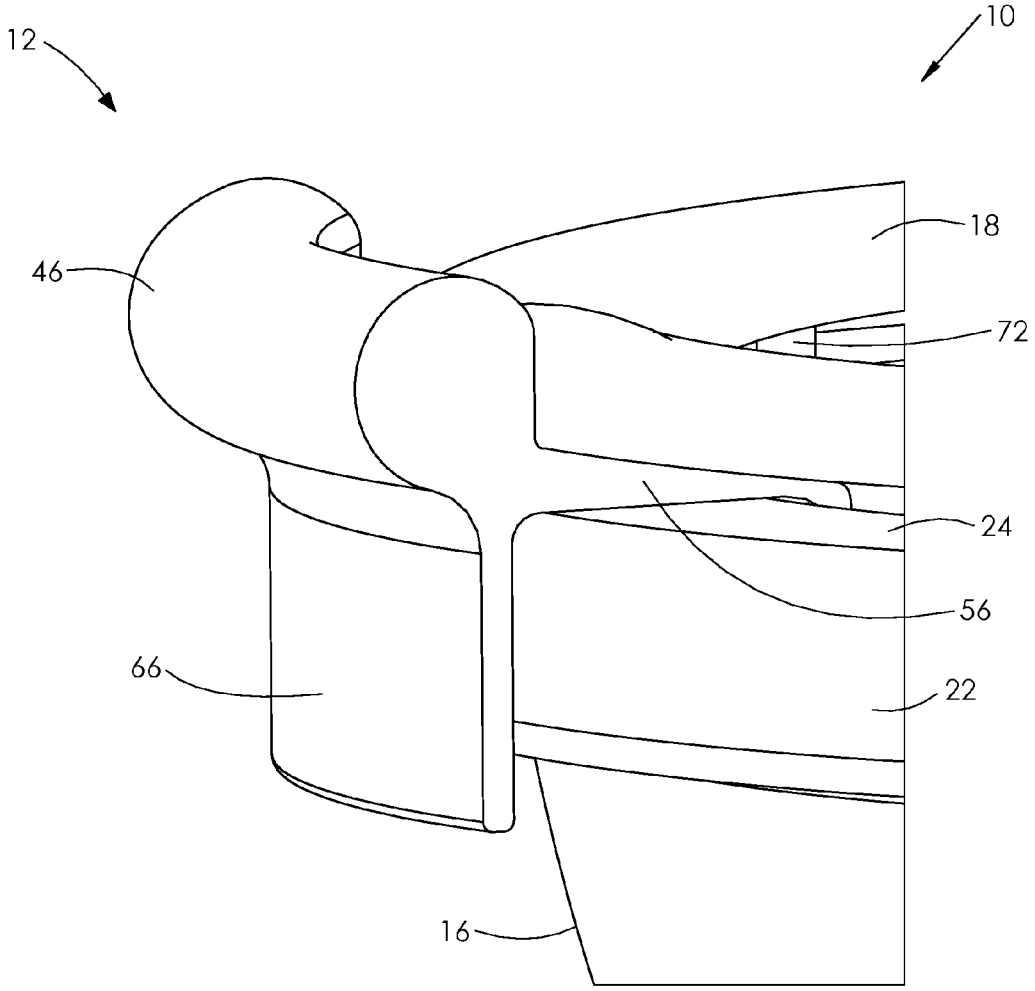
FIG. 4 is an enlarged view of a portion of the assembly of FIG. 3 showing the base of the flow projector device captured between the seat and the rim of the toilet.
Figure 5:
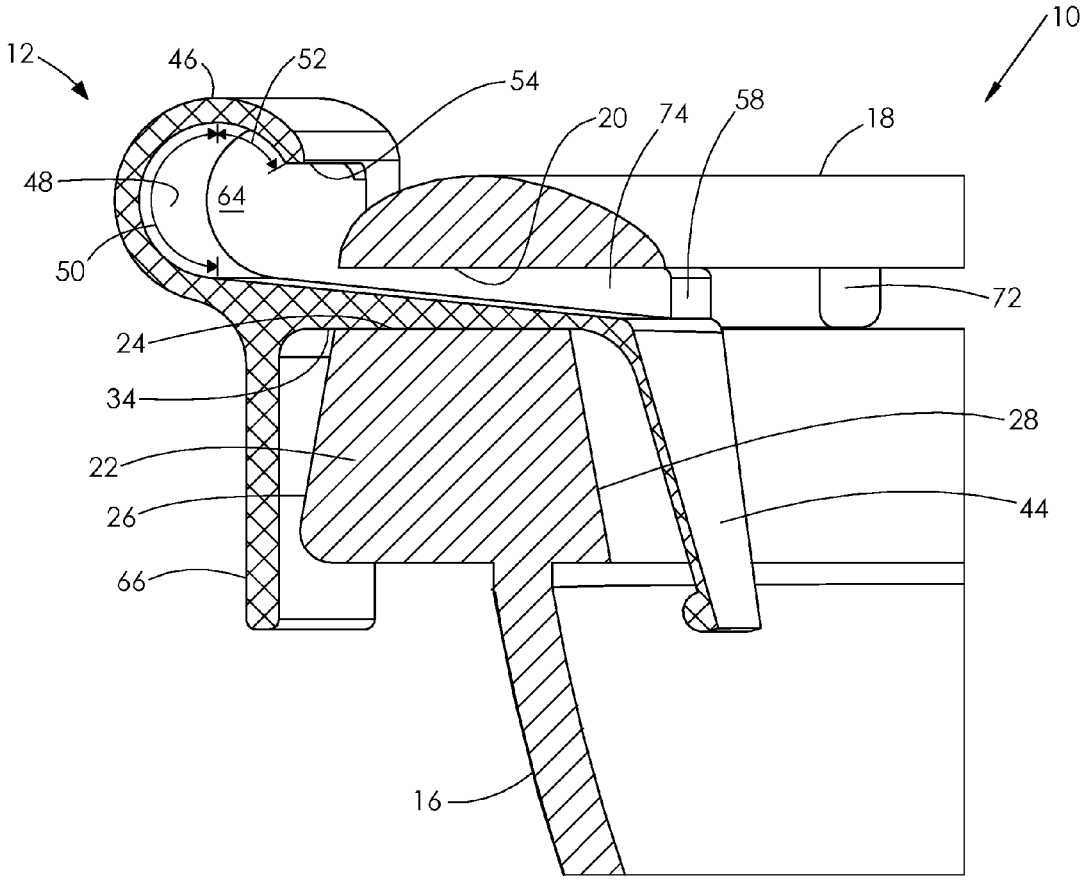
FIG. 5 is a cross-sectional view taken through the flow projector device and toilet of FIG. 4.
Figure 6:
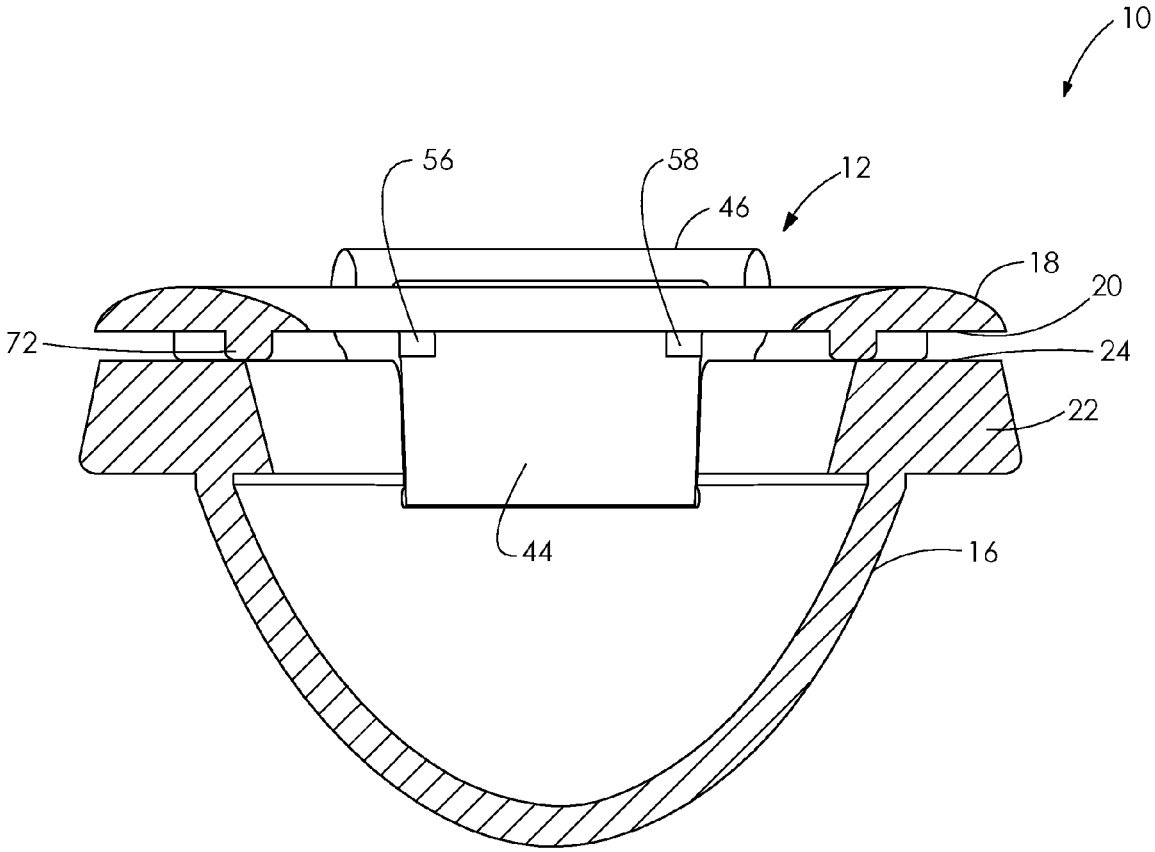
FIG. 6 is a cross-sectional view oriented 90° from the cross-sectional view of FIG. 3 taken through the toilet showing the flow projector device captured between the rim and the toilet seat.
Figure 7:
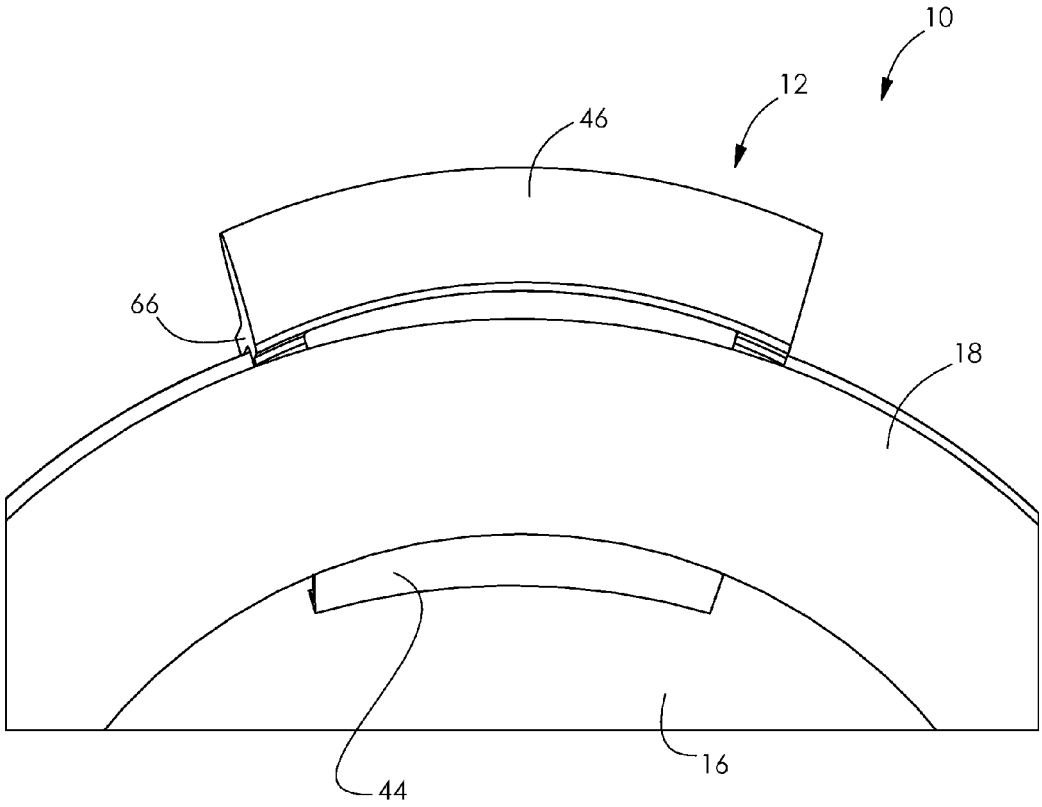
FIG. 7 is a top plan view of the structure of FIG. 4.

Flow projector device 12 also includes an outer barrier 46 extending upwardly from the outer end 38 of base 30. The outer barrier 46 includes a C shaped recurved surface 48 including a first portion 50 and a second portion 52. The first portion 50 extends from the outer end 38 of base 30 generally upwardly away from the upper surface 32. The second portion 52 extends from the first portion 50 generally downwardly toward the upper surface 32. The outer end 54 of second surface portion 52 terminates at a position overlying the upper surface 32 of base 30. Recurved surface 48 is, as discussed below, configured to redirect urine to the upper surface 32 of base 30. While recurved surface 48 is, in this example, a smoothly curving surface, it could be made of flat surfaces, curved surfaces, or a combination thereof. Sidewalls 56, 58 extend upwardly from the upper surface 32 of base 30 along the lateral sides 40, 42 and to the ends 60, 62 of outer barrier 46. The height of sidewalls 56, 58, that is the distance between lower surface 34 of base 30 and the upper surfaces 68, 70 of sidewalls 56, 58, is about 0.4 inches in this example. Recurved surface 48 defines a urine catch/return cavity 64 bounded by sidewalls 56, 58. In this example the included angle defined by the outer surfaces of sidewalls 56, 58, see FIG. 2, is about 32°.

Flow projector device 12 also includes a support bracket 66 extending downwardly from the outer end 38 of base 30. Outer end 38 and support bracket 66 have curved shapes generally corresponding to the curvature of outer rim surface 26 and inner rim surface 28, respectively.

In some examples recurved surface 48 may not include a second, generally downwardly directed portion 52. Also, recurved surface 48 may be other than a circular or other smoothly curved surface, but could be made of straight sections or a combination of straight and curved sections. In addition, the sections need not be joined by tangent lines. It is preferred that upper surface 32 and recurved surface 48 have no tight corners for ease of cleaning.

In use, flow projector device 12 is mounted between the rim 22 of toilet bowl 16 and seat 18. When so positioned, return portion 44 is opposite the inner surface 28 of rim 22 and support bracket 66 is opposite the outer surface 26 of rim 22. Lower support surface 34 of base 30 is supported by upper rim surface 24. In the example shown in FIG. 3, lower surface 20 of seat 18 is shown resting on upper surface 70 of sidewall 58. In some examples a lower seat surface 20 may be positioned above the upper surfaces 68, 70 of sidewall 56, 58; the distance above is preferably relatively short so to make a minimal change in orientation of seat 18. Whether or not there is any such distance will depend upon the length of any seat supports 72 extending from lower surface 20 of seat 18. A gap 74 is defined between the upper surface 32 of base 30 and lower seat surface 20. Gap 74 is a variable height gap which is in this example is about 0.3 inch at inner end 36 and about 0.15 inch towards outer end 38.

Through the use of flow projector device 12, a misdirected stream of urine from a male user, which could otherwise pass between lower seat surface 20 and upper rim surface 24 and onto the floor, is directed into the gap 74 at inner end 36 of base 30, along the upper surface 32 and towards the recurved surface 48. This misdirected urine can have its direction reversed by recurved surface 48 and be redirected by the second surface portion 52 back onto the upper surface 32. The misdirected urine can then flow back down the upper surface 32, past the return portion 44 and into the toilet bowl 16. Whether misdirected urine will reach recurved surface 48 will depend upon the force of the urine flow. Also, the user is provided with audio feedback that the device is working by the sound of the misdirected urine stream flowing into the toilet. After use, flow projector device 12 can be simply removed from the rim 22 of toilet bowl 16, cleaned and then replaced.

The above descriptions may have used terms such as above, below, top, bottom, over, under, et cetera. These terms may be used in the description and claims to aid understanding of the invention and not used in a limiting sense.

While the present invention is disclosed by reference to the preferred embodiments and examples detailed above, it is to be understood that these examples are intended in an illustrative rather than in a limiting sense. It is contemplated that modifications and combinations will occur to those skilled in the art, which modifications and combinations will be within the spirit of the invention and the scope of the following claims. For example, flow projector device 12 is shown as a device that can be used with existing toilet 14. However, flow projector device 12 can be made as part of toilet 14, typically as part of toilet bowl 16 or as part of seat 18. Flow projector device 12 could also be designed so that it clips onto or otherwise is attached to toilet bowl 16; this could be achieved by, for example, engaging the underside of rim 22 or through the use of adhesive securing lower support surface 34 to upper rim surface 24.

Any and all patents, patent applications and printed publications referred to above are incorporated by reference.

What is claimed is:

1. A flow projector device, for use with a toilet having a toilet bowl with a toilet bowl rim and an overlying seat, the seat placeable in a use position generally parallel to the toilet bowl rim and supported by the toilet bowl rim, comprising:

a base having an upper surface, a lower support surface, an inner end, an outer end, and lateral sides extending between the inner and outer ends, the base positionable between the seat and the toilet bowl rim with the seat in the use position;

the upper surface sloping downwardly from the outer end toward the inner end;

a return portion extending downwardly from the inner end;

an outer barrier extending upwardly from the outer end, the outer barrier comprising a recurved surface configured to redirect urine to the upper surface of the base;

the recurved surface having first and second portions, the first portion extending from the base generally upwardly away from the upper surface of the base and the second portion extending from the first portion, the second portion terminating at an outer end at a position directly overlying the upper surface and outward of the seat with no portion of the seat between the outer end and the upper surface; and the recurved surface defining a urine catch/return cavity;

whereby urine directed along the upper surface towards the recurved surface can be redirected by the recurved surface directly back onto the upper surface of the base to flow down the upper surface, past the return portion and into the toilet bowl.

2. The flow projector device according to claim 1, further comprising sidewalls extending upwardly from the upper surface of the base along the lateral sides.

3. The flow projector device according to claim 2, wherein the sidewalls extend about 0.4 inch above the lower surface of the base.

4. The flow projector device according to claim 1, further comprising a support bracket extending downwardly from the outer end of the base.

5. The flow projector device according to claim 1, wherein the upper surface is a generally flat surface.

6. The flow projector device according to claim 1, wherein the second portion extends from the first portion generally downwardly toward the upper surface of the base.

7. The flow projector device according to claim 6, wherein the recurved surface is generally C shaped.

8. The flow projector device according to claim 6, wherein the recurved surface is a smoothly curving surface.

9. The flow projector device according to claim 1 wherein the downwardly sloping upper surface slopes at an angle of about 12° to 20° to the lower support surface of the base.

10. A flow projector device, for use with a toilet having a toilet bowl with a toilet bowl rim and an overlying seat, the seat placeable in a use position generally parallel to the toilet bowl rim and supported by the toilet bowl rim, comprising:

a base having an upper surface, an inner end, an outer end, and lateral sides extending between the inner and outer ends, the base positionable between the seat and the toilet bowl rim with the seat in the use position;

the upper surface sloping downwardly from the outer end toward the inner end;

a return portion extending downwardly from the inner end;

an outer barrier extending upwardly from the outer end, the outer barrier comprising a generally C shaped recurved surface configured to redirect urine to the upper surface of the base;

the recurved surface having first and second portions, the first portion extending from the base generally upwardly away from the upper surface of the base and the second portion extending from the first portion generally downwardly toward the upper surface of the base;

the second surface portion terminating at an outer end at a position directly overlying the upper surface of the base and outwardly of the seat with no portion of the seat between the outer end and the upper surface;

sidewalls extending upwardly from the upper surface of the base along the lateral sides; and a support bracket extending downwardly from the outer end of the base;

whereby urine directed along the upper surface towards the recurved surface of the outer barrier can be redirected by the second portion of the recurved surface back onto the upper surface to flow down the upper surface, past the return portion and into the toilet bowl.

11. A flow projector assembly comprising:

a toilet comprising a toilet bowl and an overlying seat, the seat having a lower seat surface, the seat placeable in a use position;

the toilet bowl comprising a rim having an upper rim surface opposite and generally parallel to the lower seat surface when the seat is in the use position, an outer surface and an inner surface;

a flow projector device comprising:

a base having an upper surface, a lower support surface, an inner end, an outer end, and lateral sides extending between the inner and outer ends, the base positioned between the seat and the toilet bowl rim and resting on the toilet bowl rim;

the upper surface sloping downwardly from the outer end toward the inner end;

a return portion extending downwardly from the inner end;

an outer barrier extending upwardly from the outer end, the outer barrier comprising a recurved surface configured to redirect urine to the upper surface of the base;

the recurved surface having first and second portions, the first portion extending from the base generally upwardly away from the upper surface and the second portion extending from the first portion generally downwardly toward the upper surface, the second portion terminating at an outer end at a position directly overlying the upper surface and outwardly of the seat with no portion of the seat between the outer end and the upper surface;

the second surface portion terminating at a position overlying the upper surface of the base;

sidewalls extending upwardly from the upper surface of the base along the lateral sides, the sidewall having upper sidewall surfaces; and a support bracket extending downwardly from the outer end of the base;

the return portion being opposite the inner surface of the rim and the support bracket being opposite the outer surface of the rim; and a gap defined between the upper surface of the base and the lower seat surface;

whereby urine directed into the gap from the inner edge of the base and along the upper surface towards the recurved surface can be redirected by the second surface portion of the recurved surface directly back onto the upper surface to flow down the upper surface, past the return portion and into the toilet bowl.

12. The flow projector assembly according to claim 11, wherein the upper surface is a generally flat surface.

13. The flow projector assembly according to claim 11, wherein the return portion and the support bracket have curved cross-sectional shapes.

14. The flow projector assembly according to claim 11, wherein the recurved surface is generally C shaped.

15. The flow projector device according to claim 11, wherein the downwardly sloping upper surface slopes at an angle of about 12° to 20° to the lower support surface of the base.

16. The flow projector device according to claim 11, wherein the gap is about 0.3 inch to 0.15 inch high.

17. The flow projector device according to claim 11, wherein the sidewalls extend about 0.4 inch above the lower surface of the base.

* * * * *

UNITED STATES PATENT AND TRADEMARK OFFICE

CERTIFICATE OF CORRECTION

PATENT NO. : 8,887,320 B2
APPLICATION NO. : 13/234566
DATED : November 18, 2014
INVENTOR(S) : DeZarn et al.

It is certified that error appears in the above-identified patent and that said Letters Patent is hereby corrected as shown below:

In the claims,

In Claim 14, column 6, line 60, after the word "claim", delete "11" and insert -- 13 --.

Signed and Sealed this
Fifth Day of May, 2015

Michelle K. Lee

Michelle K. Lee
*Director of the United States Patent and Trademark Office*